United States Patent [19]

Suzuki et al.

[11] Patent Number: 5,076,306

[45] Date of Patent: Dec. 31, 1991

[54] DISH WASHER WITH DRYER

[75] Inventors: Hajime Suzuki; Kosaku Kataoka; Kenji Yamane; Kentaro Mochizuki, all of Otsu, Japan

[73] Assignee: Sanyo Electric Co., Ltd., Osaka, Japan

[21] Appl. No.: 438,167

[22] Filed: Nov. 16, 1989

[30] Foreign Application Priority Data

Nov. 16, 1988 [JP] Japan ..... 63-290414
Nov. 16, 1988 [JP] Japan ..... 63-290415
Nov. 18, 1988 [JP] Japan ..... 63-292893

[51] Int. Cl.[5] ..... A47L 15/48

[52] U.S. Cl. ..... 134/95; 34/77; 68/20; 134/103

[58] Field of Search ..... 137/95, 99, 103; 68/20; 34/76, 77

[56] References Cited

U.S. PATENT DOCUMENTS 3,023,757 3/1962 Mixon ..... 134/103 X
3,026,628 3/1962 Berger, Sr. et al. ..... 34/76 X
3,068,877 12/1962 Jacobs ..... 134/99
3,103,227 9/1963 Long ..... 134/99

FOREIGN PATENT DOCUMENTS 60-37100 8/1981 Japan .
0119993 6/1985 Japan ..... 34/77
0139297 7/1985 Japan ..... 34/77
0241491 11/1985 Japan ..... 37/77
61-12768 7/1986 Japan .

*Primary Examiner*—Philip R. Coe
*Attorney, Agent, or Firm*—Darby & Darby

[57] ABSTRACT

A dish washer with dryer comprising a washing and drying compartment defined in a main body wherein tableware to be cleaned and dried are loaded, a washing pump for spraying cleaning water into the compartment, a heater and fan for feeding drying air into the compartment after the spraying of the cleaning water, the dish washer with dryer comprising:

a leading inlet and outlet for the drying air located on a compartment wall of the washing and drying room;

suction and exhaust holes for outside air located on an outer body wall of the main body wall;

a circulating air pathway for connecting the leading inlet with the leading outlet and a cooling air pathway for connecting the suction hole with the exhaust hole between the room wall and the outer body wall;

a double faced fan which forms a part of a partition board by which both pathways are partitioned.

7 Claims, 8 Drawing Sheets

DISH WASHER WITH DRYER

BACKGROUND OF THE INVENTION (i) Field of the Invention

The present invention relates to a dish washer with dryer which accommodates dishes and other tableware to be cleaned and dried in a washing and drying compartment and is made so that air for drying is supplied by a fan after water is sprayed by a washing pump on to dishes and other tableware placed in the machine.

(ii) Description of the Prior Art

An example of the dish washers with dryer of such a kind is disclosed in Published unexamined Japanese Utility Model Application No. 112768/1986. The dish washer with dryer described in the publication is constructed so that outside air is drawn into the machine by a blower and heated by a heater. Dishes and other tablewares are dried by the air which has been heated and after the washing cycle, is complete, then, the air is exhausted properly to the outside. The air to be exhausted is normally of a high temperature containing vapor and steam.

In order to prevent injury caused by spouting of vapor and steam during the washing process, a method for condensation and lowering the temperature by means of a heat exchange to prevent spouting is disclosed in Published Japanese Utility Model Application No. 37100/1985.

SUMMARY OF THE INVENTION

A dish washer with dryer comprising a washing and drying compartment defined in a main body wherein tableware to be cleaned and dried are loaded, a washing pump for spraying cleaning water into the compartment, a heater and fan for feeding drying air into the compartment after the spraying of the cleaning water, the dish washer with dryer comprising:

a leading inlet and outlet for the drying air located on a compartment wall of the washing and drying room;

suction and exhaust holes for outside air located on an outer body wall of the main body wall;

a circulating air pathway for connecting the leading inlet with the leading outlet and a cooling air pathway for connecting the suction hole with the exhaust hole between the room wall and the outer body wall;

a double faced fan which forms a part of a partition board by which both pathways are partitioned.

Namely, the dish washer with dryer of the present invention is respectively composed of pathway for circulating air located in the washing and drying compartment and connected to a leading inlet and outlet for drying air, and an air cooling pathway located on the outer wall of the main body and connected to a suction and exhaust holes for the outside air, and moreover, a fan and partition board which face and separate both of the pathways, thereby not entirely exhausting the dry air to the outside and therefore outside air is not required for drying in all cases.

Dish washers with dryers are generally placed in kitchens or rooms for cooking. However, the air contained in those rooms has high humidity in most cases. The dish washers with dryer of the present invention will not change environmental conditions in the room by raising the humidity and will not lower the drying efficiency by using high humidity air for drying.

DETAILED DESCRIPTION OF THE PREFERRED EMBODIMENTS

Figure 1:
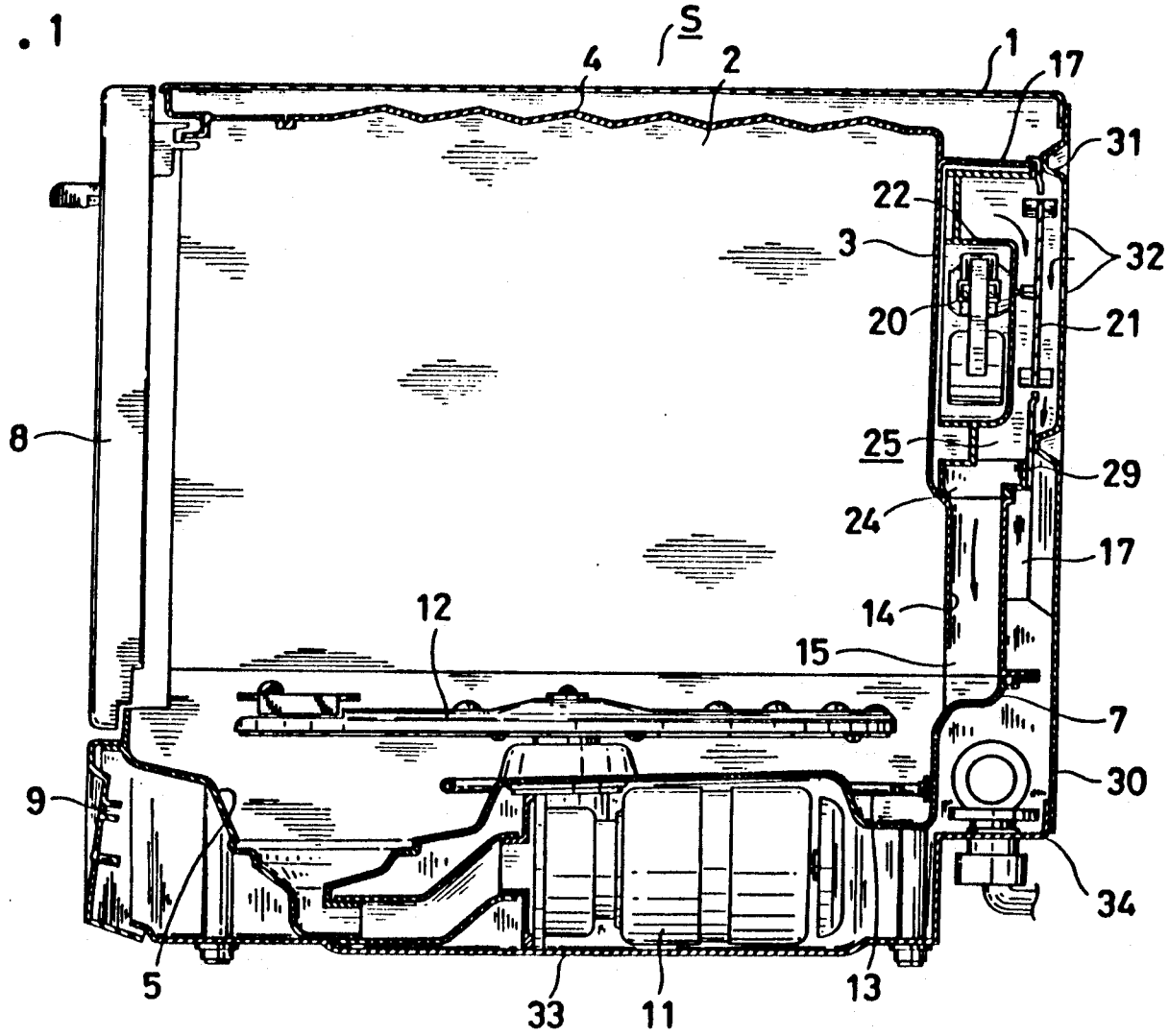
FIG. 1 is a sectional side view showing an embodiment of dish washer with dryer of the present invention.
Figure 2:
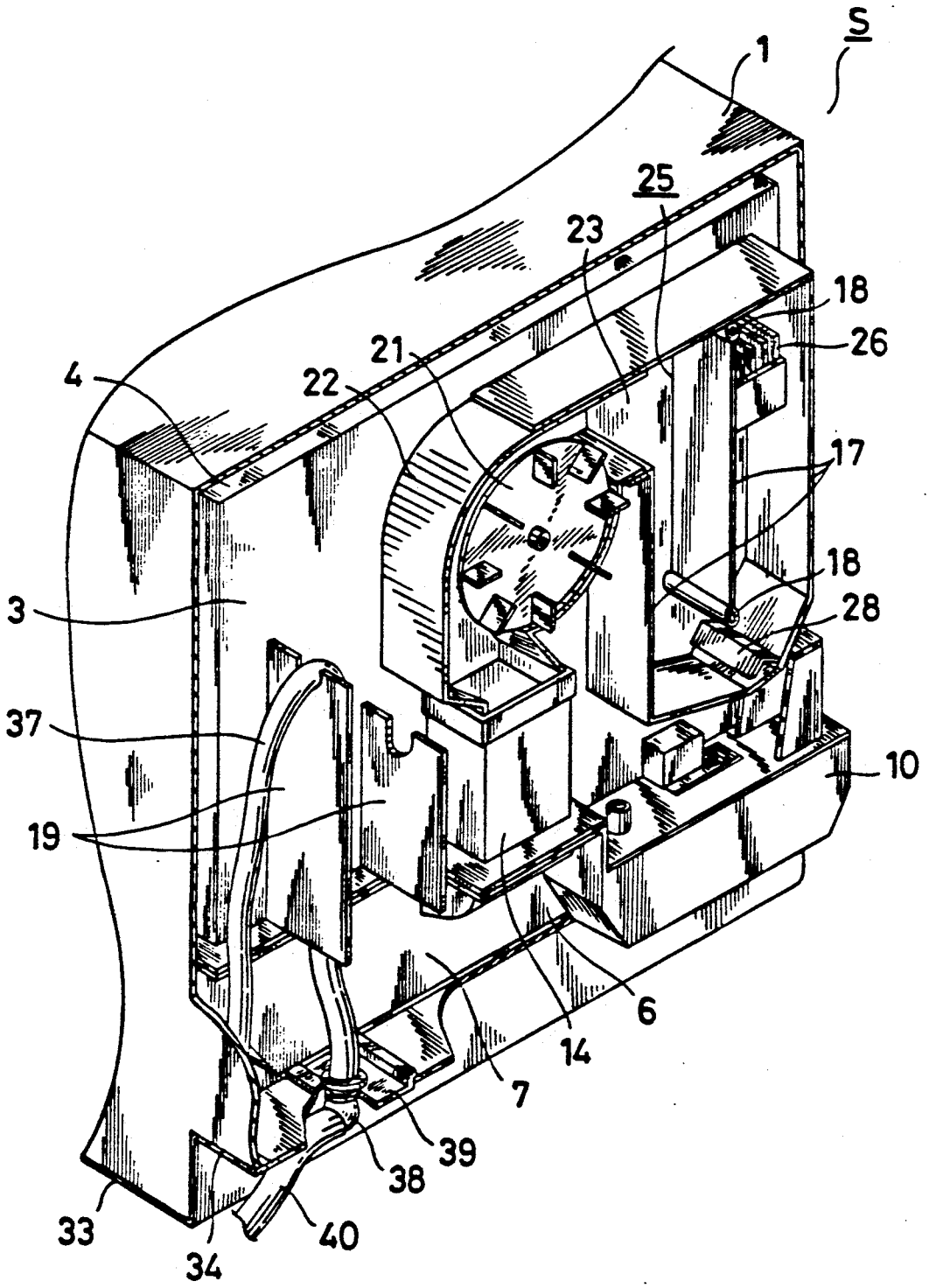
FIG. 2 is a rear view with portion broken away for the sake of clarity.
Figure 3:
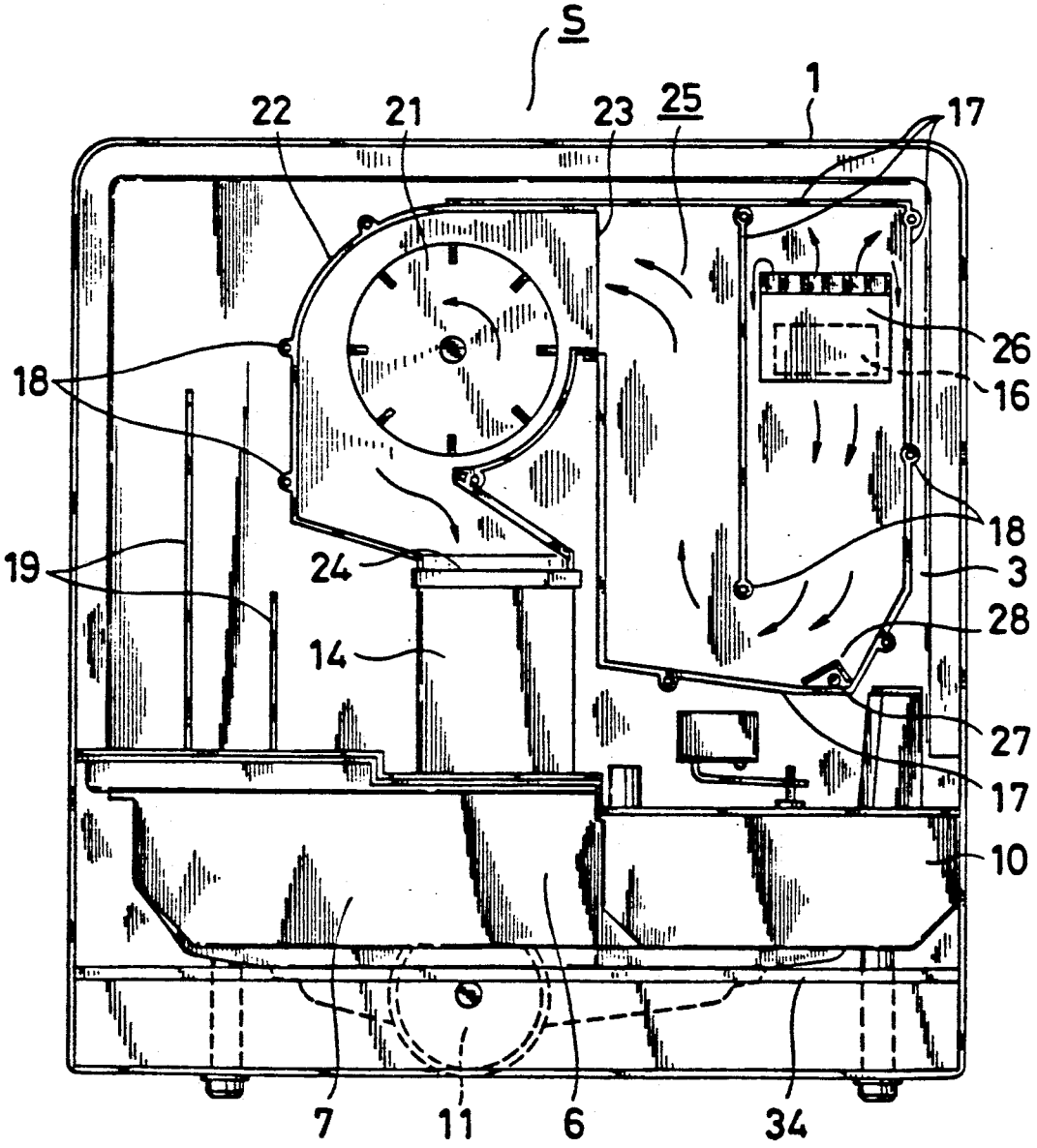
FIG. 3 is a rear view showing the internal mechanism.
Figure 4:
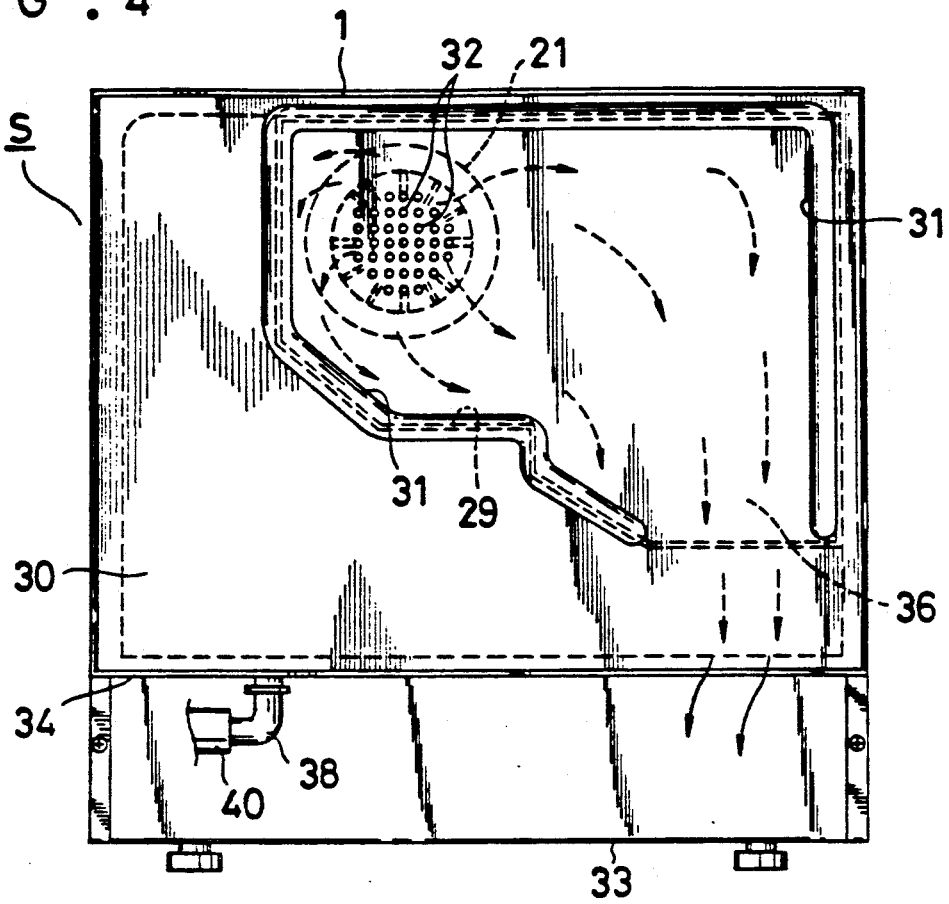
FIG. 4 is a rear view.
Figure 5:
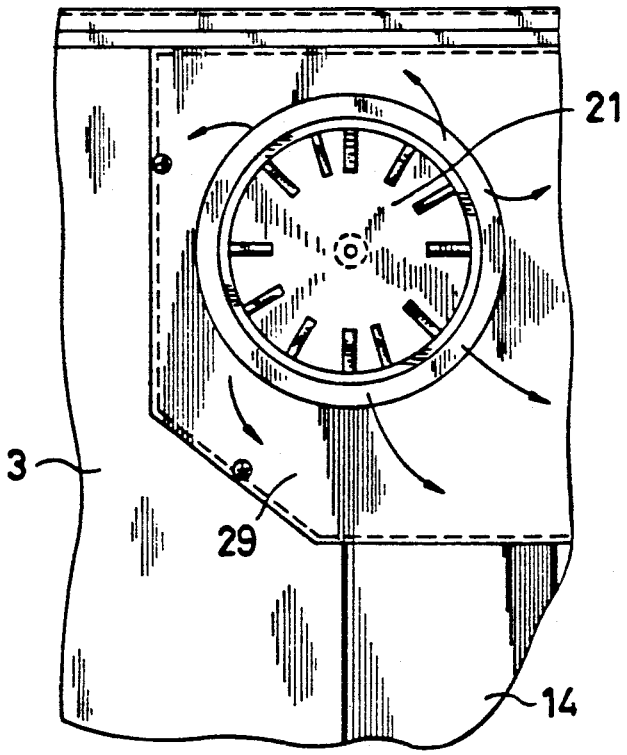
FIG. 5 is rear view showing a main part fixed with a partition board.
Figure 6A:
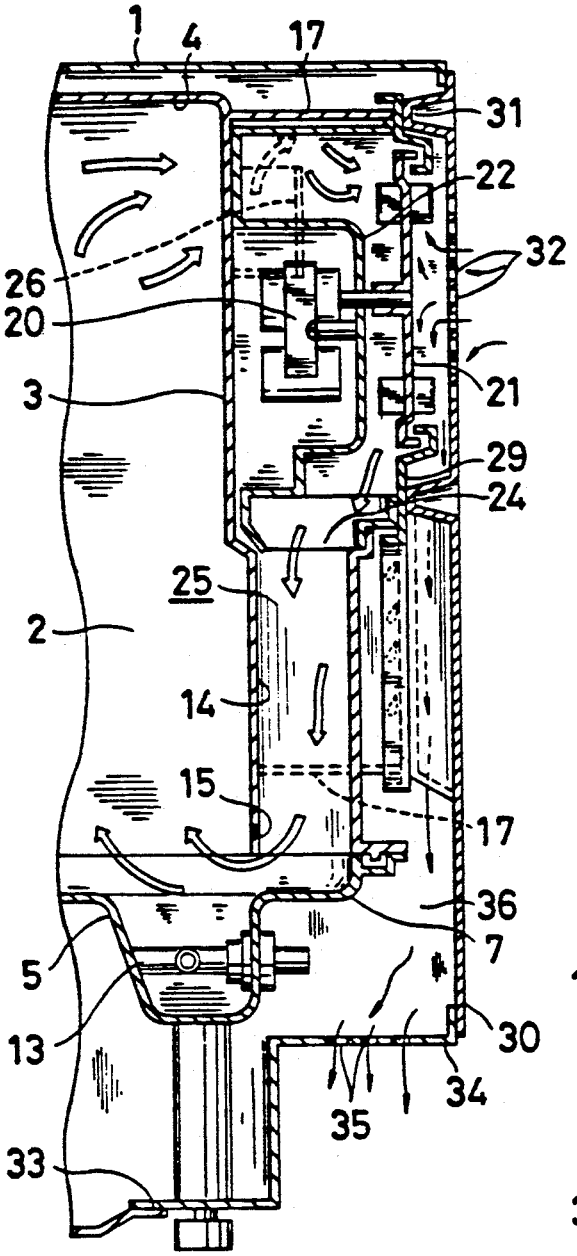
FIGS. 6(A) and (B) are sectional side views showing the main parts respectively located in different positions.
Figure 6B:
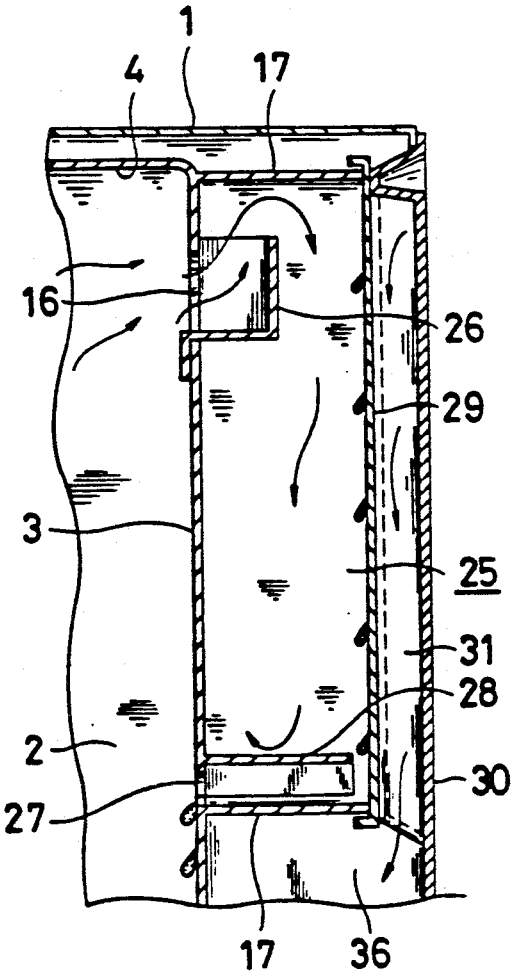

Hereinafter, the dish washer with dryer of the present invention will be explained according to FIG. 1 to FIG. 8. A washing and drying plastic compartment 2 is located in a machine made of metal frame 1 of the dish washer with dryer (S).

The drying compartment 2 is composed of an upper case 4 formed with the upper wall, both side walls and back wall 3 in one molded body and having an open-type lower portion, and a lower case 7 formed with the bottom wall 5, both side walls, front wall and back wall 6 in one molded body by jointing one to the other. A door 8 and panel 9 are located in the front face of the machine frame 1 and drying compartment 2.

The upper case 4 and lower case 7, wherein the back wall 6 is formed with the water compartment 10 as one body, integral unit with adhesive and other fastening means. In the washing and drying compartment 2 formed in such a manner, a nozzle 12 executes the washing by spraying water by means of a pump 11 and a heater 13 which raises the temperature of the washing water (rinsing water) and generates hot air by heating the air in the compartment during the drying process. Also, they are located so that dishes can be placed and removed easily.

The upper case 4 comprises a vertical duct 14 in the lower and central portion of back wall 3. A leading inlet 15 having an upward cut shape is located as one integral unit at the lower end part of the back wall 3 (along the jointing) corresponding to the duct 14. The upper case 4 is also formed with a leading outlet 16 in one upper end of back wall 3 together with a rib 17 in the back face of the back wall 3 so that a U-shaped pathway is formed on the back face near the center thereof while surrounding the outlet 16. Moreover, bosses 18 and reinforcing ribs 19 are formed in the proper portions as one body.

A fan casing 22 composed of a driving motor 20 and double faced fan 21 is fixed in the upper central part of the back wall 3 of the upper case 4. And, a suction opening 23 is jointed with the end of a U-shaped pathway formed by the rib 17 and a delivery hole 24 which is joined to the aforesaid duct 14 at its upper side. That is, the circulating air pathway runs from the drying compartment 2 through leading outlet 16, U-shaped pathway 25, suction opening 23, double faced fan 21, delivery opening 24, duct 14, and leading inlet 15 and returns to drying compartment 2.

In the leading outlet 16, the body frame 26 has an L-shaped section installed which can be easily dismantled to deflect the drying air in the upward direction. A drain hole 27 is also formed together with a guard rib 28 surrounding the hole 27 from upper side in an umbrella-shape and deflecting the drying air and is formed as one integral unit at the lowest portion of the U-shaped pathway.

The backside of the circulating air pathway 25 is closed by a partition board 29 except the back faces of the duct 14 and double faced fan 21. The partition board 29 can be composed of metal, plastic or other materials, and is fixed on the boss 18.

The back face of the machine frame 1 is covered with a back cover 30 made of metal. The back cover 30 is formed with a recessed part 31 attached on the outside of the partition board 29 and the lowest portion of the U-shaped pathway, and is formed together with suction holes 32 having many holes facing the double faced fan 21. Also, an exhaust hole 35 is formed on the part corresponding to the lowest portion of the U-shaped pathway of the swelled stepped portion 34 which is formed on the back side of bottom plate 33 of the machine frame 1. Namely, the cooling air pathway 36 therefore has the routing from the suction opening 32 through the double faced fan 21 to the exhaust opening 35 which is formed by partitioning between the partition board 29 and back cover 30 with a recessed part 31.

Drainage from the washing and drying compartment 2 is carried out by reversing the pump 11. The drain hose 37 is assembled on the reinforcing rib 19 and is bent to form an upside down U-shape. The drainage hole of the hose 37 is installed in an L-shaped elbow 38. On the other hand, a supporting plate 39 is horizontally extended toward the notched portion of the swelled stepped portion 34 from the lower case 7 as one integral unit. And, the supporting plate 39 is installed so that the stepped portion 34 which covers the notched portion and the plate is fixed if necessary. The supporting plate 39 is also positioned below the stepped portion 34 and is set around the elbow 38 so that the elbow can be rotated. However, the parts are engaged by cogs for each of the other eight (8) points around the inserted portion so that the parts are not easily rotated but can be moved step by step during rotation.

Figure 8A:
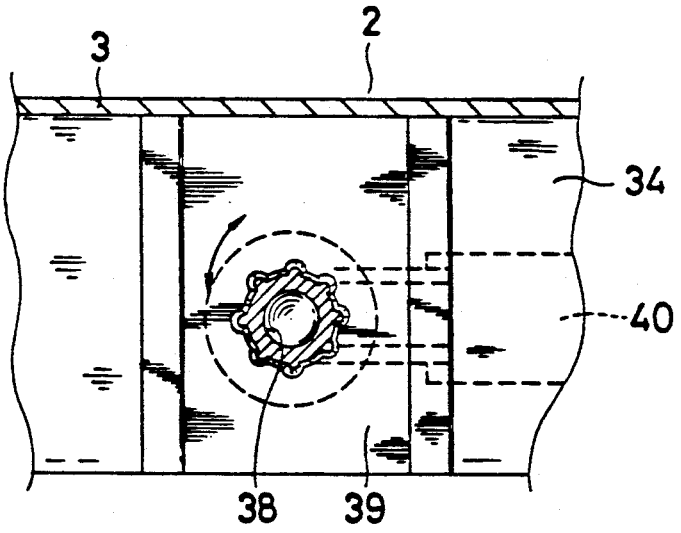
FIGS. 8(A) and (B) are sectional plan and side views showing a main part.
Figure 8B:
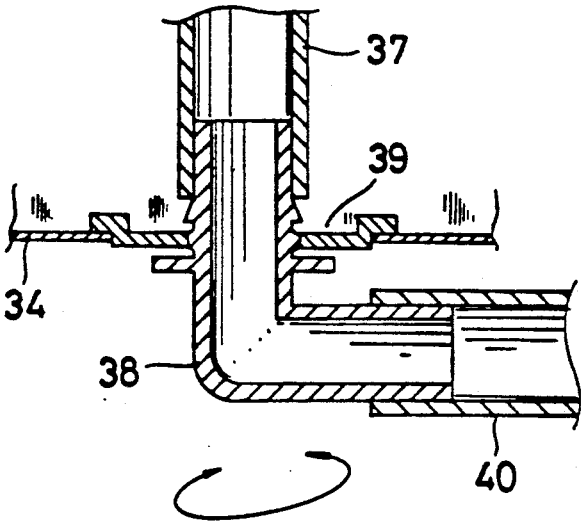

The elbow 38 made of a relatively soft plastic is formed by blow molding process including the aforesaid cogged section and stopping flange to connect the drain hose 40 of the end below the stepped portion 34 [Refer to FIGS. 8(A) and (B)].

Next, each cycle (process) of washing and drying will be explained.

After the door 8 is opened and dishes and other tableware are put in the washing and drying compartment 2, when the starting key is turned, water is supplied from the water supply source until the water surface reaches the cleaning water level. Cleaning water is then sprayed from the nozzle 12 by the pump 11 while the water is circulating. The cleaning water is then heated by the heater 13 till it becomes warm. During washing, the cleaning water is made fresh several times, however, the cleaner or detergent is supplied only on the first cycle. After the second cycle, each washing operation is combined with rinsing.

When the last washing cycle is completed and water fully drained, the heater 13 and double faced fan 21 (motor 20) are activated. The compartment air is heated by the heater 13 and the air is circulated between the circulating wind pathway 25 and drying compartment 2 by the double faced fan 21. Moreover, the outside air is also passed into the cooling air pathway 36 by the double faced fan 21.

Since the drying air is drawn from the suction side of the double faced fan 21, flow velocity of the air is slow. After the air goes out from the leading outlet 16 in the upward direction, the air flows downward and upward again. Then, the air is drawn into the fan 21 and reaches the duct 14 leading to the inlet 15. On the other side, since the outside air is drawn from the suction opening 32 just near the double faced fan 21, flow velocity of the air is quick. So, the air lowers the temperature of that portion of the U-shaped pathway.

Accordingly, since the drying air which goes out to the circulating air pathway 25 has a slow flow velocity, there is a large cooling capacity and large area of heat exchange. The air is effectively dehumidified and heated again in the drying compartment 2 ready for drying.

Figure 7:
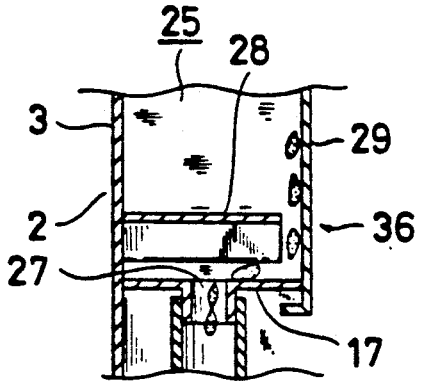
FIG. 7 is a sectional view of another embodiment corresponding to FIG. 6.

Condensation is generated in the U-shaped pathway of the circulating air pathway 25. The water flows down along the partition board 29 to the drain hole 27 in the lowest portion and then, the water is discharged from the drying compartment 2. As shown in FIG. 7, the water can be discharged through the drain hole 27 on the rib 17 in the lowest portion of U-shaped pathway.

Here, in addition to being close to the guard rib 28 by about 2 mm distance from the rib 17 in the lowest portion of U-shaped pathway, the protruded face is also close, about 2 mm distance from the partition board 29. Accordingly, the circulated drying air does not flow into the drain hole 27 decreasing the dehumidification efficiency caused by leakage of the drying air.

The back wall 3 of the upper case 4 made of plastic receives the warm water spray during the washing process and passes the drying air during the drying process. Accordingly, the back wall 3 can easily generate noise plus being expanded or shrunken by the heat. However, for the dish washer with dryer according to the embodiment of the present invention, since the rib 17, reinforcing rib 19 and duct 14 standing away from the back wall 3 to form the U-shaped pathway are composed as one integral unit, in addition to increasing the strength, the noise can be suppressed. Furthermore, since the pathway of the air is not composed of different kinds of materials, ease of assembly will be improved.

According to the dish washer with dryer (S) as mentioned above, since the heat of the air used for drying is exchanged with outside air during the circulation of drying air between the drying room and air circulation pathway, the drying air will become dehumidified and the drying efficiency can be increased markedly. Also, reduction of the environmental conditions of the kitchen or cooking room caused by drainage due to air of high humidity can be prevented. Therefore, a dish washer with dryer possessing high drying performance and a high degree installation flexibility is created.

Furthermore, according to the dish washer with dryer (S), the washing and drying compartment made of plastic is reinforced by the ribs which constitute the circulating pathway. In addition, to achieve the damping action against impingement of the cleaning water, leakage of the air and water can be prevented by suppressing the expansion caused by heat. Also, leakage of air from the drain hole can be inhibited by applying the guard rib. Therefore, a dish washer with dryer possessing high drying efficiency and yet emitting a minimum of noise during washing can be created.

Figure 9:
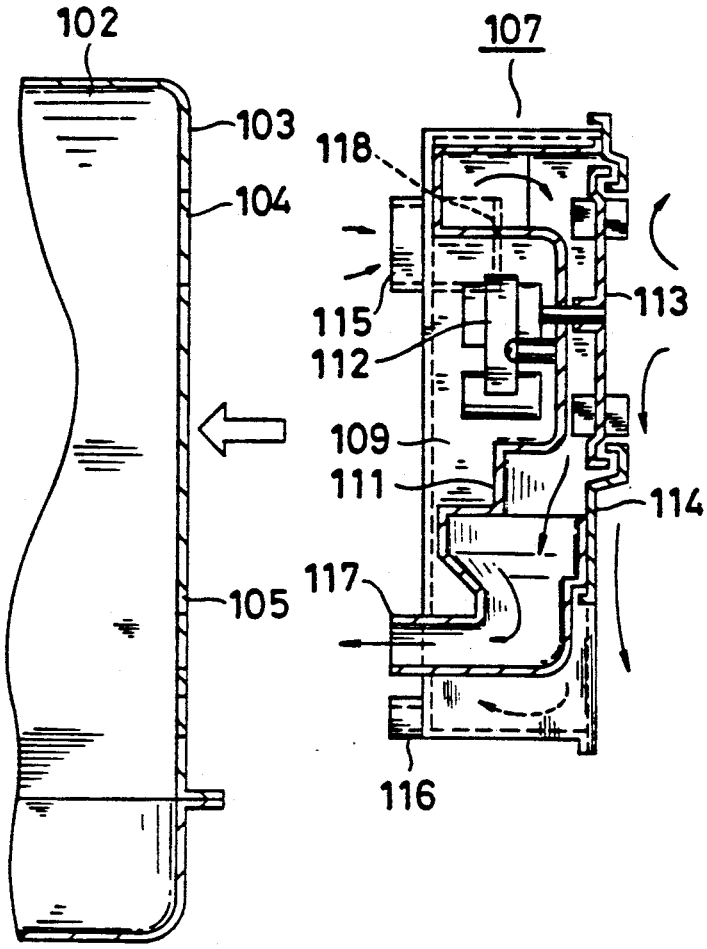
FIG. 9 is a sectional side view of a main part which explains the method of assembly and shows another embodiment of dish washer with dryer.
Figure 10:
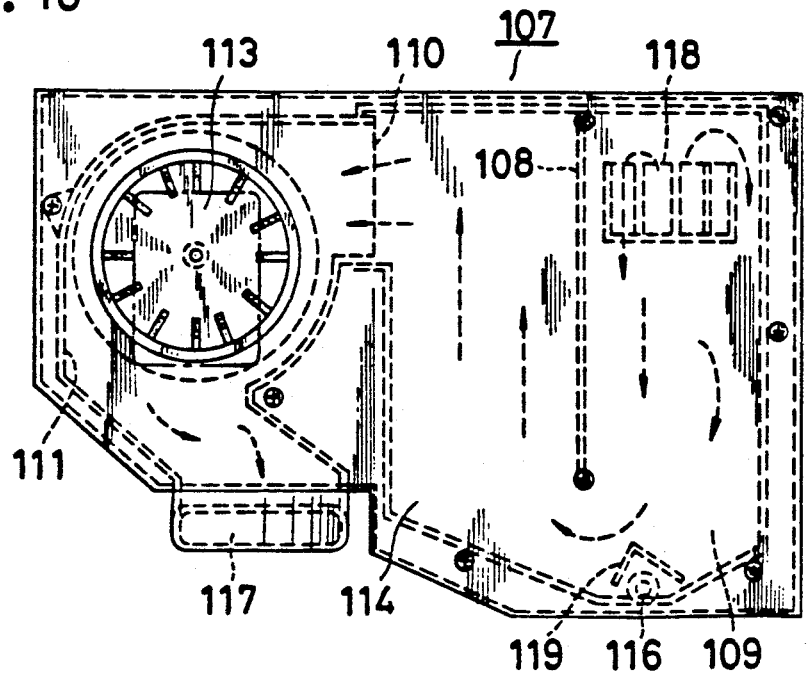
FIG. 10 is a rear view showing a heat exchanger unit.
Figure 11:
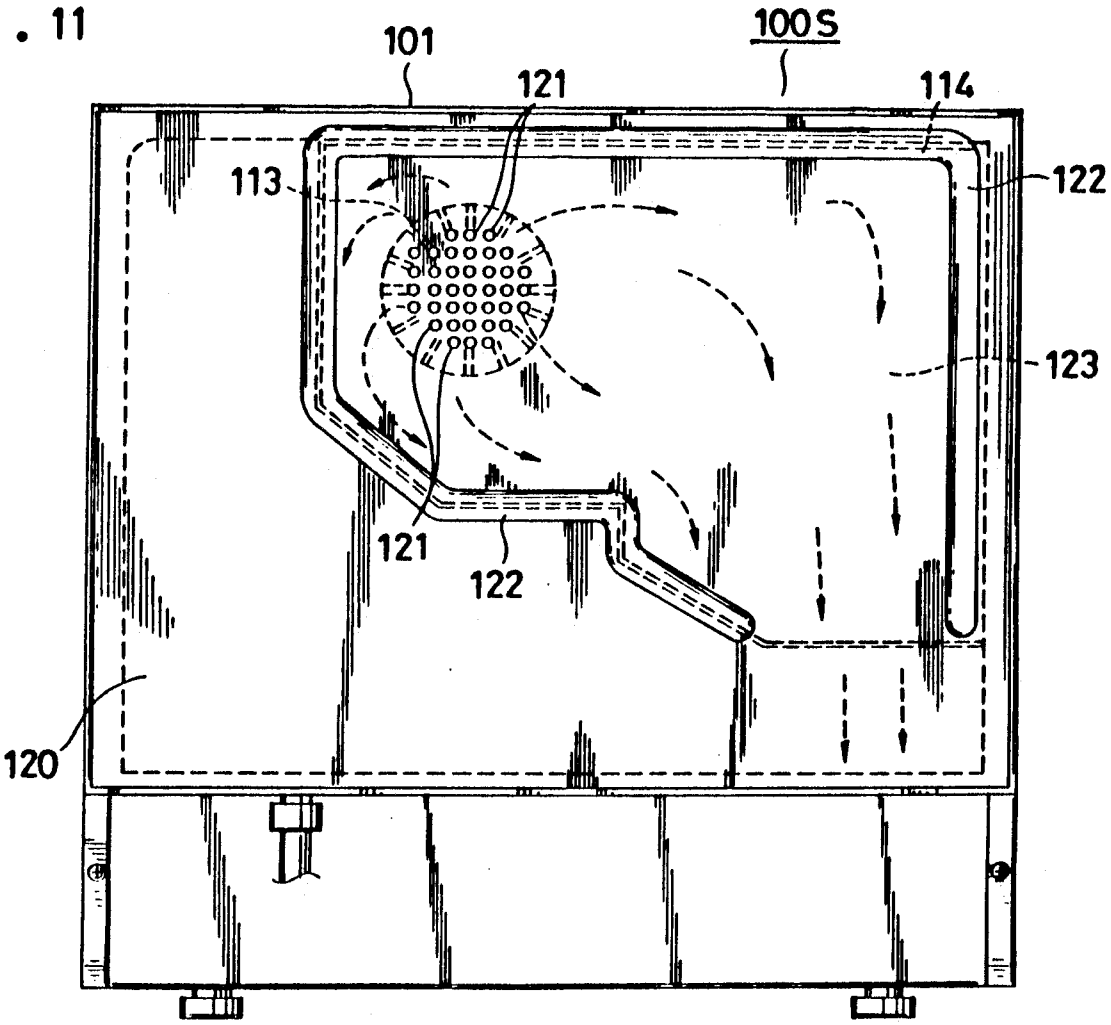
FIG. 11 is a rear view corresponding to FIG. 4.

Next, another embodiment of the present invention will be explained according to FIGS. 9 to 11. A washing and drying compartment 102 composed of upper and lower cases is located in the machine (metal fabrication) frame 101. A nozzle which does the washing work while cleaning water is circulated by a pump and a heater to increase the temperature of the cleaning water (rinsing water) and heats the interior air of the compartment for dish drying are located in the drying compartment 102.

A door and panel is provided in the front face portion of the machine frame 101 and drying compartment 102.

Here, a leading outlet 104, leading inlet 105 and drain hole 106 for condensation is opened on the room wall 103 of the upper case of the aforesaid drying compartment 102 (for example, back wall or side wall).

A heat exchanger unit 107 is composed of a U-shaped pathway 109 partitioned by a plastic made rib 108 hanging in the box, fan casing 111 connected with a suction opening 110 at the terminal end of the U-shaped pathway in the horizontal axis, a motor 112 and double faced fan 113 fixed on the casing 111, the U-shaped pathway 109 and casing 111 in a closed form and a partition board 114 which exposes the outer face of the double faced fan 113.

A inlet tube 115 protrudes from the starting end of the box bottom face of the U-shaped pathway 109 as one integral unit and a drain tube 116 also protrudes on the lowest portion of the box bottom face of the U-shaped pathway 109 as one integral unit. The oblong delivery opening of the fan casing 111 is a delivery opening 117 extending in the same direction as that of the aforesaid tubes 115 and 116, and is located on the lower portion of the fan.

The fan casing 111 is fixed on a partition board 114 and the partition board 114 is fixed on a boss protruded from the U-shaped pathway 109. The partition board 114 is a plate made of metal or plastic having high heat exchange performance characteristics. An upward deflector 118 is located inside the box of the leading exit tube 115. Also, an umbrella-shaped guard rib 119 is provided inside the box drain tube 116 as one integral unit in order to prevent the air leakage.

Then, the relative positioning between the leading outlet 114 and the leading exit tube 115, between the leading inlet 105 and the delivery tube 117, and between the drain hole 106 and drain tube 116 are arranged so as to correspond to each other. The tubes are respectively inserted into the corresponding holes (including outlet and inlet) by applying the heat exchanger 107 unit from the back side of the washing and drying compartment 102 and the unit 107 is fixed by adequate means at three supporting points. In such a manner, the drying compartment 102 is connected to the circulating air pathway which consists of the U-shaped pathway 109 and fan casing 111.

Accordingly, during drying, the drying air is circulated inside the inner face of the double faced fan 113 between the drying room 102 and the circulating air pathway by driving the double faced fan 113. The outside air flows along the outer face of the partition board 114 outside the outer face of the fan. Thereby, heat exchange is carried out through the partition board 114 and the drying air is also dehumidified, so, the drying efficiency is increased. The condensation on the inner face of the partition board 114 flows down from the drain tube 116 through the drain hole 106 and is discharged from the drying compartment 102.

The heat exchanger 107 unit is covered with a back cover 120 of the machine frame 101. In order to improve the flow of the outside air, the cooling air pathway 123 is created in the space between the back cover 120 and partition board 114 by the suction hole 121 with many holes and recessed part.

According to the dish washer with dryer (100S) as described in the above, since the drying air is dehumidified and reused, the drying efficiency can be improved. Moreover, since function of heat exchanger (dehumidification) is formed in a unit which is demountable, the ease of assembly can also be improved.

What is claimed is:

1. A dish washer with dryer including a washing and drying compartment within a main body wherein tableware to be cleaned and dried are loaded, said compartment having walls, and said main body having outer body walls, a washing pump for spraying cleaning water into the compartment, a heater and fan for feeding drying air into the compartment after the spraying of the cleaning water, comprising:

an inlet and outlet for drying air located on one said compartment wall of the washing and drying compartment;

suction and exhaust openings for outside air located on an outer body wall of the main body;

a circulating air pathway for providing communication between the drying air inlet and the drying air outlet, said circulating air pathway including a U-shaped portion having two vertical arms joined at a connection at their lower ends to form said U-shaped, said drying air entering the upper end of one said arm, flowing downward, turning at said connection and then flowing upward in the other said arm;

a cooling air pathway for providing communication between the suction opening and the exhaust opening, said cooling air pathway being between the compartment wall and the outer body wall; and a partition having a fixed portion and a moving portion separating said drying air pathway from said cooling air pathway, air movement on both sides of said partition transferring heat through said partition to condense moisture from said drying air; and a double faced rotating fan having a rotation disc which forms said moving portion of said partition by which both pathways are separated, heat transfer to said cooling air from said drying air occurring through said disc, said fan circulating said drying air and cooling air in their respective pathways; and a drive motor for driving said double face fan, said drive motor being located in the main body out of said cooling air pathway.

2. A dish washer with dryer as defined in claim 1, wherein the circulating air pathway is formed in a shape having at least one curved portion.

3. A dish washer with dryer as defined in claim 1, wherein the circulating air pathway includes a drain hole located on the bottom of the U-shape thereof and connected with the washing and drying compartment from the bottom thereof.

4. A dish washer with dryer as defined in claim 3, and further comprising an umbrella-shaped rib which integrally protrudes from the circulating air pathway, and covers the drain hole to prevent the leakage of air.

5. A dish washer with dryer as defined in claim 1, wherein the circulating air pathway includes a part of one said compartment wall, ribs integrally formed on said part of the compartment wall and the partition are a casing for the double faced fan.

6. A dish washer with dryer as defined in claim 1, wherein the outer body wall is reinforced and the main body comprises a part of a wall of the cooling air pathway.

7. A dish washer with dryer as defined in claim 1, wherein a portion of the circulating air pathway and the fan are removably engaged with the main body, the circulating air pathway being connected to the inlet and outlet of the main body.

* * * * *